US005873133A

United States Patent [19]

Jurga et al.

[11] Patent Number: 5,873,133

[45] Date of Patent: Feb. 23, 1999

[54] BELT INCLUDING AN EXTENSIBLE MID-PORTION AND BUCKLE AND TAIL TAB PORTIONS FORMED OF INJECTION MOLDED SYNTHETIC PLASTIC MATERIAL

[75] Inventors: Stan M. Jurga, Shirley, Mass.; Mike Chien-Fang Chen, Taipei Hsien, Taiwan

[73] Assignee: Ampac Enterprises, Inc., Shirley, Mass.

[21] Appl. No.: 523,516

[22] Filed: Sep. 1, 1995

[51] Int. Cl.[6] ..... A41F 9/00

[52] U.S. Cl. ..... 2/322; 2/336

[58] Field of Search ..... 2/322, 321, 311, 2/336, 338; 24/265 BC, 265 A, 182, 178

[56] References Cited

U.S. PATENT DOCUMENTS 1,973,646 9/1934 Mix ..... 2/322

5,046,197 9/1991 Chernuchin et al. ..... 2/322

*Primary Examiner*—Gloria M. Hale

*Attorney, Agent, or Firm*—Diller, Ramik & Wight, PC

[57] ABSTRACT

A sports belt, particularly a baseball belt, which includes from one end to the other a buckle, a buckle tab portion, a loop, an elongated belt mid-portion which is preferably adjustable and a tail tab portion. The tail tab portion and the buckle tab portion are each constructed from a single piece of injection molded synthetic polymeric/copolymeric plastic material. The tail tab portion is injection molded with a slot between two connecting tabs into which is slid a terminal end of the mid-portion of the belt which is stitched and/or adhesively bonded thereto. The buckle tab portion is defined by central and opposite end portions with intermediate portions of lesser thickness therebetween about which the buckle tab portion can be folded to unite thereto a buckle and a looped portion of the elastic belt mid-portion.

17 Claims, 1 Drawing Sheet

FIG. 1
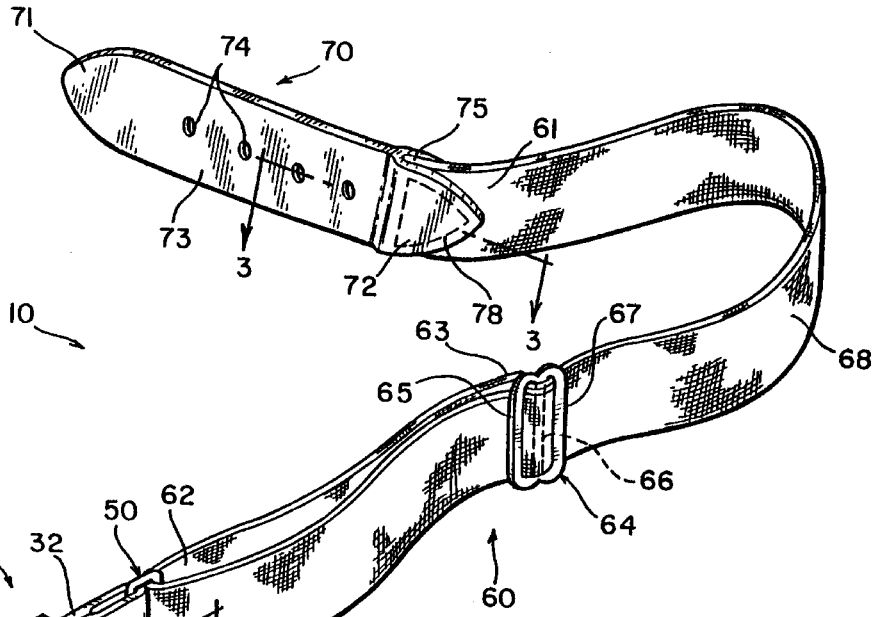
FIG. 2
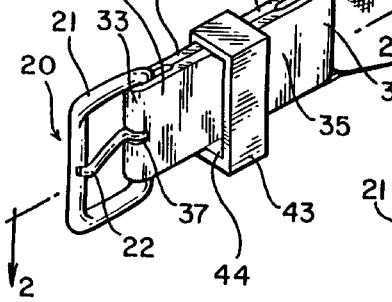
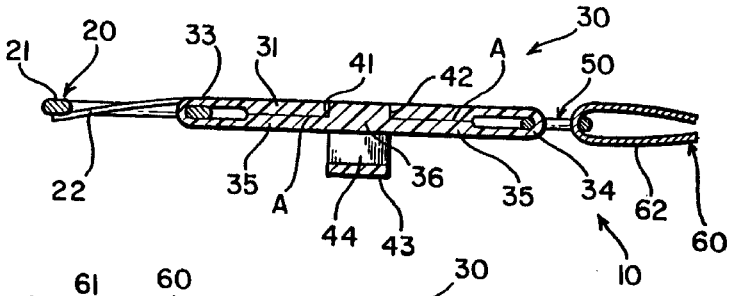
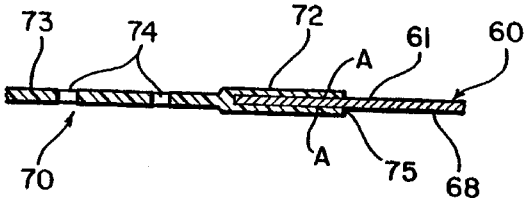
FIG. 3
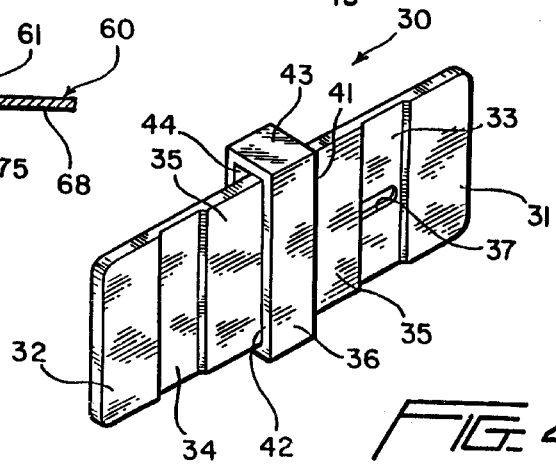
FIG. 4

BELT INCLUDING AN EXTENSIBLE MID-PORTION AND BUCKLE AND TAIL TAB PORTIONS FORMED OF INJECTION MOLDED SYNTHETIC PLASTIC MATERIAL

BACKGROUND OF THE INVENTION

The invention is directed to a belt, and specifically to a baseball belt which presently is manufactured from numerous pieces which must be individually manufactured and united to each other by time-consuming operations which do not ensure consist belt quality. Such a sports belt includes a tail tab portion normally formed from leather which has first and second opposite terminal end portions, the latter of which is slit to define a slot or gap into which is inserted a first terminal end portion of an elongated adjustable belt mid portion which is normally constructed from elastic material. A second terminal end portion of the belt terminal end portion of the belt mid portion is passed through a loop and folded upon itself and the latter loop is in turn secured to a belt buckle by another web of leather material which is folded upon itself with the folded portions being stitched to both secure the buckle to the adjacent loop and also secure a separate belt retaining loop in position to receive the first terminal end portion of the tail tab portion. The buckle, buckle tab portion and the loop of the latter are thus assembled and united in a very time-consuming fashion.

SUMMARY OF THE INVENTION

In keeping with the present invention, the belt includes from one end to the other a buckle, a buckle tab portion, a loop, an elongated belt mid-portion which is preferably adjustable and a tail tab portion. The belt mid portion and adjusting loop thereof and the loop which connects the belt mid portion to the buckle tab portion are each of a conventional construction. The novelty of the present belt resides in the specific construction of the tail tab portion and the buckle tab portion.

The tail tab portion is constructed from a single piece of injection molded synthetic polymeric or copolymeric plastic material and includes opposite first and second terminal ends or terminal end portions between which are a plurality of apertures or holes for receiving a buckle tongue or catch. The second terminal end portion is essentially bifurcated and a slot or groove is injection molded therein which receives a first terminal end portion of the belt mid portion. The first terminal end portion of the belt mid portion and the second terminal end portion of the tail tab portion are stitched together. Due to the latter construction, it is no longer necessary, as is now conventional, to construct the tail tab portion from leather and slit the same essentially centrally of the plane of the material to define the slot or gap. The present invention is thereby more cost-effective because leather is more expensive than injected molded plastic and when constructed from leather, the tail tab portion is undesirably thick because it must be slit essentially equally at the second terminal end portion thereof. Therefore, leather is selected which is unnecessarily thick to accommodate for the loss of strength when the material is essentially slit to half its thickness. Also, due to the exacting nature of the injection molded tail tab portion, irregularities of thickness which occur during the slitting of conventional leather tail tab portions is totally eliminated. Obviously, the slitting operation is entirely eliminated. Therefore, by injection molding the tail tab portion, the disadvantages of forming a tail tab portion from leather are totally eliminated.

The buckle tab portion of the invention is also constructed from injection molded polymeric or copolymeric synthetic plastic material in the form of a strip which has a mid portion defining a loop at one side and a central portion with a raised abutment bar at an opposite side. The central portion and opposite terminal end portions are of essentially the same thickness and are joined to each other by reduced thickness portions which provide areas which can be folded or overfolded to bring the terminal end portions into overlapped relationship to the central portion after a buckle loop and a connecting loop have been assembled thereto. The terminal end portions are adhesively bonded to the central portion to complete the unification/assembly of the buckle, the buckle tab portion and the loop joined to the belt mid portion. Due to the latter injection molded construction of the buckle tab portion, it is no longer necessary to construct the same in the present conventional manner from two separate pieces of leather material which are variously folded and overfolded and stitched both each to itself to form a loop and secure the conventional leather buckle tab portion to an associated connecting loop and a buckle loop. Therefore, the stitching required to form a loop and the stitching required to secure the loop to a leather connecting web which is in turn twice stitched upon itself is totally eliminated which again reduces the cost of the fabrication and assembly and at the same time increases quality.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a perspective view of a novel belt constructed in accordance with this invention, and illustrates from one end to the other a buckle, a buckle tab portion, a connecting loop, an adjustable elongated preferably elastic belt mid-portion, and a tail tab portion with the buckle tab portion and the tail tab portion being constructed from a single piece of injection molded synthetic polymeric or copolymeric plastic material.

FIG. 2 is a slightly enlarged fragmentary cross-sectional view taken generally along line 2—2 of FIG. 1, and illustrates details of the injection molded buckle tab portion including the manner in which overfolded portions thereof connect the buckle tab portion to the connecting loop and the buckle loop.

FIG. 3 is a fragmentary cross-sectional view taken generally along line 3—3 of FIG. 1, and illustrates details of the tail tab portion including a slot defined by the bifurcated terminal end.

FIG. 4 is a perspective view of the buckle tab portion, and illustrates details of a central portion which is raised to define an abutment bar and two portions of reduced thickness which allow terminal end portions of the buckle tab portion to be overfolded to the position shown in FIG. 2.

DESCRIPTION OF THE PREFERRED EMBODIMENT

A novel belt, preferably a sports belt, constructed in accordance with this invention is generally designated by the reference numeral 10 (FIG. 1), and is typical of a baseball belt.

The belt 10 is defined from one end to the other by a buckle 20, a buckle tab portion 30, a connecting loop 50, an elongated belt mid-portion 60 and a tail tab portion 70.

The buckle 20, the connecting loop 50 and the belt mid portion 60 are each of a conventional construction.

The buckle 20 includes a buckle loop 21 which is preferably constructed of metallic material, as is a buckle tongue or catch 22 which is pivotally connected to the buckle loop 21 in a conventional manner.

The conventional connecting loop 50 is also constructed preferably from metal and is of a generally rectangular configuration.

The elongated belt mid-portion 60 is preferably constructed from an elastic web of material and includes a first terminal end portion 61 and a second terminal end portion 62 which is essentially a looped portion folded upon itself after passing through the connecting loop 50. A free terminal end 63 of the belt mid-portion is connected to adjusting means in the form of a metallic adjusting loop 64 which includes opposite parallel legs 65, 67 and a leg 66 spaced from the legs 65, 66 in parallel relationship thereto. Elastic web material 68 passes between the openings (unnumbered defined by the legs 65–66 to allow the adjusting loop 64 to be slid along the web 68 in a conventional fashion to adjust the overall length of the belt 10.

The tail tab portion 70 includes a first terminal end or end portion 71 and a second terminal end or end portion 72 and a mid-portion 73 therebetween provided with a plurality of holes or apertures 74 which receive the buckle tongue or catch 22 in a conventional fashion. The tail tab portion 70 is injection molded from polymeric/copolymeric plastic material in a mold (not shown) which forms the apertures 74 and the overall configuration of the tail tab portion 70 including the bifurcated nature of the second terminal end portion 72 which defines a slot or groove 75 thereof. The first terminal end portion 61 of the web 68 of the belt mid portion 60 is slid into the slot 75 and is secured thereto by stitching 78 (FIG. 1). Adhesive A can be utilized in lieu of or in addition to the stiching 78, and is preferably applied to opposite faces (unnumbered) of the first terminal end portion 61 of the web 68 to firmly adhesively bond the same to the second terminal end portion 72 of the tail tab portion 70 (See FIG. 3).

The buckle tab portion 30 includes opposite terminal end portions or ends 31, 32, intermediate portions 33, 34, respectively, and a central portion 35. The portions 31, 32 and 35 are of the same thickness which is approximately twice the thickness of the intermediate portions 33 and 34. One side (unnumbered) of the central portion 35 includes a raised abutment bar or abutment portion 36 having opposite abutment faces 41 and 42. An opposite face (also unnumbered) of the buckle tab portion 30 includes an integral loop portion 43 defining a channel 44 which receives the terminal end portion 71 of the tail tab portion 70 in a conventional manner after the buckle tongue or catch 22 has been inserted into one of the holes 74. The intermediate portion 33 also includes a slot 37 located generally along the central axis (unnumbered) of the buckle tab portion 30 through which conventionally passes the catch 22 of the buckle 20.

The buckle tab portion 30 is assembled to the connecting loop 50 and the buckle loop 20 by inserting the first end portion 31 of the buckle tab portion 30 through the buckle loop 21 and passing the buckle tongue or catch 22 through the opening or slot 37. The intermediate portion 33 is then folded upon itself, as is evident in FIGS. 1 and 2, and abutting surfaces are adhesively bonded to each other as indicated by the adhesive A in FIG. 2. The end portion 32 of the buckle tab portion 30 is inserted through the connecting loop 50 after which the intermediate portion 34 is folded upon itself, as is evident in FIG. 2. Adhesive A is utilized to bond the abutting surfaces in the manner evident in FIG. 4. Preferably, the adhesive A bonds surfaces of the terminal end portions 31, 32 which abuttingly overly and engage the central portion 35 and which also abut the abutment faces 41, 42.

The novel belt 10 of the invention thus includes the novel injection molded buckle tab portion 30 and the novel injection molded tail tab portion 70, each of which exclude the disadvantages heretofore noted with respect to conventional belts of this type and, of course, provide the advantages heretofore noted.

Although a preferred embodiment of the invention has been specifically illustrated and described herein, it is to be understood that minor variations may be made in the apparatus without departing from the spirit and scope of the invention, as defined the appended claims.

We claim:

1. A belt comprising a buckle tab portion, a tail tab portion and an elongated mid-portion therebetween; said tail tab portion being a single piece of injection molded synthetic plastic material and having a slot within which is sandwiched a first terminal end portion of said elongated mid portion; said buckle tab portion being a single piece of injection molded synthetic plastic material, said buckle tab portion including opposite terminal ends, a loop between said buckle tab portion opposite terminal ends for receiving a first terminal end of said tail tab portion, said mid-portion including a portion folded upon itself, means for varying the overall length of said folded upon itself portion, and said buckle tab portion opposite terminal ends being constructed and arranged for respective securement to an associated buckle and to a second terminal end portion of said elongated mid-portion.

2. The belt as defined in claim 1 wherein said slot is at a second terminal end of said tail tab portion opposite said tail tab portion first terminal end.

3. The belt as defined in claim 1 wherein said buckle tab portion terminal ends are in overfolded relationship to a central portion of said buckle tab portion and in opposing relationship to each other, and adhesive means for bonding said buckle tab central portion to said buckle tab portion terminal ends.

4. The belt as defined in claim 1 wherein said slot is at a second terminal end of said tail tab portion opposite said tail tab portion first terminal end.

5. The belt as defined in claim 4 wherein said buckle tab portion terminal ends are in overfolded relationship to a central portion of said buckle tab portion and in opposing relationship to each other.

6. The belt as defined in claim 1 wherein said buckle tab portion terminal ends are in overfolded relationship to a central portion of said buckle tab portion and in opposing relationship to each other.

7. The belt as defined in claim 6 wherein said central portion includes a raised bar portion disposed on a side of said buckle tab portion opposite said loop.

8. The belt as defined in claim 7 wherein terminal edges of said buckle tab portion terminal ends are contiguous said raised bar portion.

9. The belt as defined in claim 7 including an intermediate portion between said central portion and each terminal end, and the thickness of each intermediate portion is substantially less than the thickness of the central portion and the terminal ends.

10. The belt as defined in claim 9 wherein said overfolded relationship is effected by overfolding one of said intermediate portions upon itself.

11. The belt as defined in claim 10 including a buckle joined to said one intermediate portion, said one intermediate portion having an elongated opening therein, and said buckle having a buckle tongue projecting through said elongated opening.

12. A belt buckle tab portion comprising a single piece of injection molded synthetic plastic material having remote opposite first and second terminal ends and a central portion therebetween collectively including a longitudinal axis, and a loop at said central portion.

13. The belt buckle tab portion as defined in claim 12 wherein said first terminal end includes an elongated opening disposed generally normal to said loop and being adapted to receive a buckle tongue.

14. The belt buckle tab portion as defined in claim 12 wherein said central portion includes a raised bar portion disposed on a side of said buckle tab portion opposite said loop.

15. The belt buckle tab portion as defined in claim 14 wherein terminal edges of said buckle tab portion terminal ends are contiguous said raised bar portion.

16. The belt buckle tab portion as defined in claim 14 including an intermediate portion between said central portion and each terminal end, and the thickness of each intermediate portion is substantially less than the thickness of the central portion and the terminal ends.

17. The belt buckle tab portion as defined in claim 16 wherein one of said intermediate portions is overfolded upon itself, a buckle joined to said one intermediate portion, said intermediate portion having an elongated opening therein, and said buckle having a buckle tongue projecting through said elongated opening.

* * * * *